US006220908B1

(12) United States Patent
Peterson

(10) Patent No.: US 6,220,908 B1
(45) Date of Patent: Apr. 24, 2001

(54) INFLATABLE TOWABLE VEHICLE

(75) Inventor: Leroy L. Peterson, Omaha, NE (US)

(73) Assignee: Sportsstuff, Inc., Omaha, NE (US)

( * ) Notice: Subject to any disclaimer, the term of this patent is extended or adjusted under 35 U.S.C. 154(b) by 0 days.

(21) Appl. No.: 09/458,381

(22) Filed: Dec. 10, 1999

(51) Int. Cl.[7] ..... B63B 35/73

(52) U.S. Cl. ..... 441/66; 114/345; 114/346; 441/67

(58) Field of Search ..... 441/65, 66, 67, 441/40, 131, 129; 114/345, 346; 52/2.11; 280/18, 18.1, 19

(56) References Cited

U.S. PATENT DOCUMENTS 2,496,460 * 2/1950 Evans ..... 441/66
2,816,299 * 12/1957 Holladay ..... 441/66
2,933,739 * 4/1960 Miler et al. .
5,231,951 * 8/1993 Tagar et al. ..... 441/131

FOREIGN PATENT DOCUMENTS

625129 * 6/1949 (GB) ..... 441/40

* cited by examiner

*Primary Examiner*—Sherman Basinger
(74) *Attorney, Agent, or Firm*—Henderson & Sturm LLP

(57) ABSTRACT

An inflatable towable vehicle including a tapered hull. The hull is formed of a plurality of concentrically disposed inflatable rings with chambers which have progressively increasing diameters from the outermost ring to the innermost ring. Interior connecting webs form shared walls for the adjacent chambers, and openings in the webs allow fluid communication between the chambers so that a single inflation valve can be used to simultaneously inflate all of the chambers. When inflated, the centers of the chambers are horizontally aligned to yield a hull profile that is tapered from both the top and the bottom. The passenger cockpit is defined by the open area in from the innermost ring, and a floor including an inflatable section and a drain opening. The tapered hull acts to minimize resistance to the water or snow over which the vehicle is being towed, and results in an aesthetically appealing vehicle profile.

14 Claims, 2 Drawing Sheets

INFLATABLE TOWABLE VEHICLE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to the field of inflatable towable vehicles, and more particularly to an inflatable towable vehicle having a tapered hull.

2. Description of the Related Art

Inflatable towable vehicles are well known in the art and generally comprise an inflatable ring with a central passenger cockpit having a floor sealed to the lower edge of the ring, and typically fabricated of various plastics, such as polyvinylchloride (PVC). The profiles of the hulls of these known vehicles are generally blunt and provide significant resistance to the water or snow over which the vehicle is being towed.

While all of the aforementioned prior art constructions are more than adequate for the basic purpose and function for which they have been specifically designed, they are uniformly deficient with respect to their failure to provide a simple, efficient, and practical hull design that minimizes water and snow resistance.

As a consequence of the foregoing situation, there has existed a longstanding need for a new and improved towable vehicle and the provision of such a construction is a stated objective of the present invention.

BRIEF SUMMARY OF THE INVENTION

Briefly stated, the present invention provides an inflatable towable vehicle including a tapered hull. The hull is formed of a plurality of concentrically disposed inflatable rings with chambers which have progressively increasing diameters from the outermost ring to the innermost ring. Interior connecting webs form shared walls for the adjacent chambers, and openings in the webs allow fluid communication between the chambers so that a single inflation valve can be used to simultaneously inflate all of the chambers. When inflated, the centers of the chambers are horizontally aligned to yield a hull profile that is tapered from both the top and the bottom. The passenger cockpit is defined by the open area in from the innermost ring, and a floor including an inflatable section and a drain opening. The tapered hull acts to minimize resistance to the water or snow over which the vehicle is being towed, and results in an aesthetically appealing vehicle profile.

DETAILED DESCRIPTION OF THE INVENTION

Figure 1:
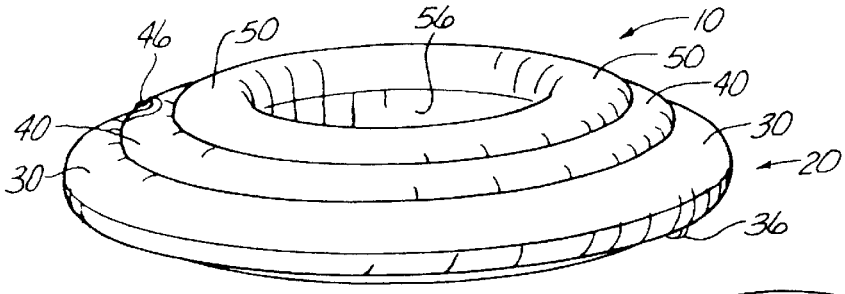
FIG. 1 is a perspective view of the inflatable towable vehicle of the present invention showing the tapered hull.
Figure 2:
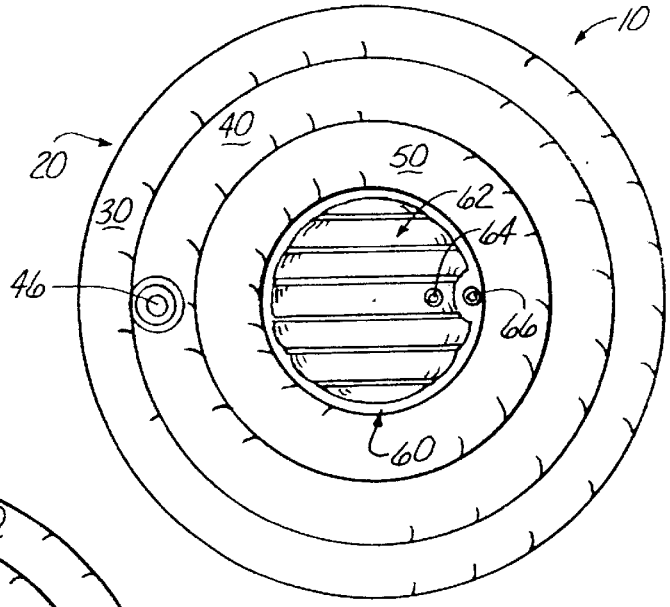
FIG. 2 is a top plan view thereof.
Figure 3:
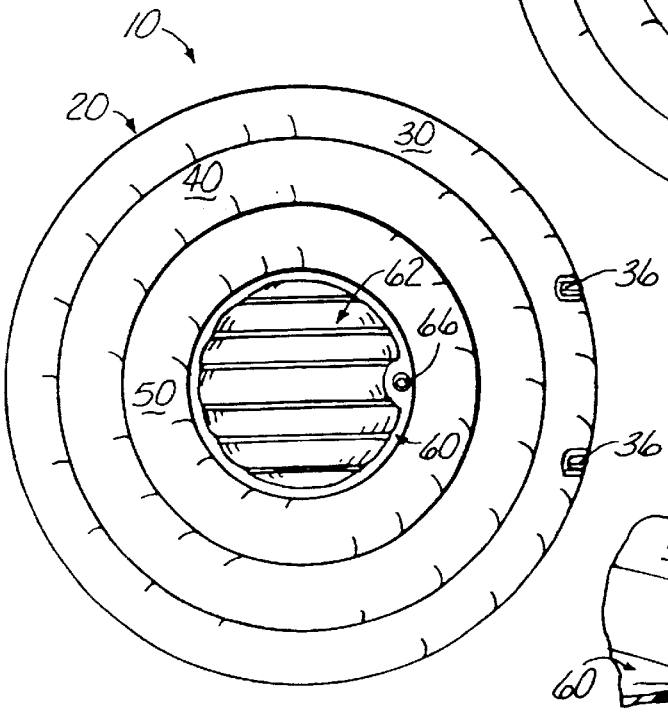
FIG. 3 is a bottom plan view thereof.

As can be seen by reference to the drawings, and in particular to FIG. 1, the inflatable towable vehicle that forms the basis of the present invention is designated generally by the reference number (10). The vehicle (10) includes a tapered hull (20) formed of first, second and third concentrically disposed rings (30), (40), (50), and a floor (60).

Figure 4:
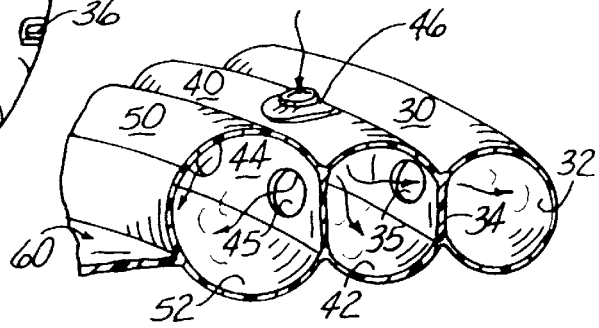
FIG. 4 is a partial top perspective sectional view showing the inflatable chambers and the openings in the webs that connect adjacent chambers.
Figure 5:
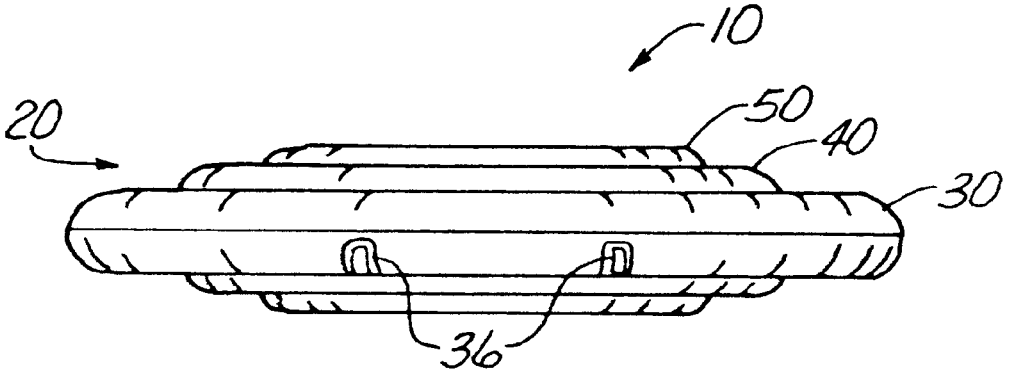
FIG. 5 is a side elevational view of the vehicle showing the hull profile tapered outwardly from both the top and bottom.
Figure 6:
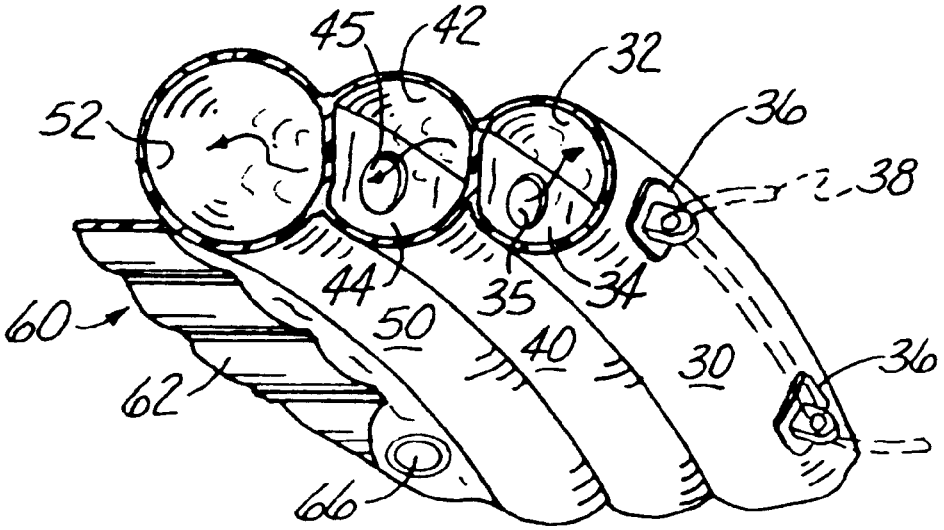
FIG. 6 is a partial bottom perspective sectional view similar to FIG. 4.

As most clearly shown in FIGS. 4 and 6, the rings (30), (40), (50) have inflatable chambers (32), (42), (52) that have progressively increasing diameters from the outermost ring (30) to the innermost ring (50). Interior connecting webs (34), (44) include openings (35), (45) that allow fluid communication between all chambers (32), (42), (52) and allow them to be inflated through a single inflation valve (46). When inflated, the chambers (32), (42), (52) have centers that are horizontally aligned to give a hull profile that is tapered from both the top and bottom as illustrated in FIG. 5. A pair of spaced towing tabs (36) are attached to the exterior surface of the outermost ring (30) to receive a tow rope (38) as shown in FIG. 6.

The open area (56) in from the innermost ring (50), together with the floor (60), defines a passenger cockpit. As shown in FIGS. 4 and 6, the floor (60) is attached by heat sealing or other suitable methods to the exterior of the innermost ring (50). The floor (60) includes an inflatable section (62) that is inflatable through port (64), and a drain opening (66).

It is to be understood that the number of concentric rings may vary and that the vehicle need not have a recessed passenger cockpit as illustrated herein.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. An inflatable towable vehicle, comprising:

a tapered hull formed of a plurality of adjacent inflatable chambers, including a first outer ring shaped peripheral chamber having a first generally circular cross-sectional area, a second inner ring shaped chamber disposed inwardly of the first chamber and having a second generally circular cross-sectional area greater than the first cross-sectional area; and a first vertical interior connecting web defining a shared wall of the first and second chambers wherein centers of the first and second chambers are horizontally aligned; and, an inflation valve disposed in fluid communication with each of the first and second chambers.

2. The inflatable towable vehicle of claim 1 wherein the first connecting web includes a plurality of openings permitting fluid communication between the first and second chambers.

3. The inflatable towable vehicle of claim 2 wherein the tapered hull further includes a third chamber disposed inwardly of the second chamber and having a third cross-sectional area greater than the second cross-sectional area, and a second vertical interior connecting web defining a shared wall of the second and third chambers; and an inflation valve disposed in fluid communication with the third chamber.

4. The inflatable towable vehicle of claim 3 wherein the second connecting web includes a plurality of openings permitting fluid communication between the second and third chambers.

5. The inflatable towable vehicle of claim 1 wherein the tapered hull further includes a third chamber disposed inwardly of the second chamber and having a third cross-sectional area greater than the second cross-sectional area, and a second vertical interior connecting web defining a shared wall of the second and third chambers; and an inflation valve disposed in fluid communication with the third chamber.

6. The inflatable towable vehicle of claim 5 wherein the second connecting web includes a plurality of openings permitting fluid communication between the second and third chambers. inflation valve disposed in fluid communication with the third chamber.

7. The inflatable towable vehicle of claim 5 wherein the first, second and third chambers define concentrically disposed first, second and third rings, respectively.

8. The inflatable towable vehicle of claim 7 wherein centers of the first, second and third chambers are horizontally aligned.

9. The inflatable towable vehicle of claim 1 wherein the hull includes a centrally disposed open area disposed inwardly of the second chamber.

10. The inflatable towable vehicle of claim 9 wherein a floor is operably attached to an exterior portion of the second chamber and is disposed to extend across the open area.

11. The inflatable towable vehicle of claim 10 wherein the floor includes an inflatable section and an inflation port disposed in fluid communication with the inflatable section.

12. The inflatable towable vehicle of claim 11 wherein the floor includes a drain opening formed in the floor.

13. The inflatable towable vehicle of claim 1 wherein the first and second chambers define concentrically disposed first and second rings, respectively.

14. The inflatable towable vehicle of claim 13 further including a pair of spaced towing tabs attached to an exterior surface of the first ring.

* * * * *